US010927484B2

(12) United States Patent
Schneider

(10) Patent No.: US 10,927,484 B2
(45) Date of Patent: Feb. 23, 2021

(54) NEEDLE REMOVING TOOL, NEEDLE REMOVING DEVICE AND NEEDLE REMOVING METHOD

(71) Applicant: AUTEFA SOLUTIONS GERMANY GMBH, Friedberg (DE)

(72) Inventor: Jan Schneider, Diedorf/Anhausen (DE)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 324 days.

(21) Appl. No.: 15/770,912

(22) PCT Filed: Oct. 21, 2016

(86) PCT No.: PCT/EP2016/075336
§ 371 (c)(1),
(2) Date: Apr. 25, 2018

(87) PCT Pub. No.: WO2017/072037
PCT Pub. Date: May 4, 2017

(65) Prior Publication Data

US 2018/0320299 A1 Nov. 8, 2018

(30) Foreign Application Priority Data

Oct. 26, 2015 (DE) ..... 20 2015 105 693 U

(51) Int. Cl.
*D04H 18/02* (2012.01)

(52) U.S. Cl.
CPC ..... *D04H 18/02* (2013.01)

(58) Field of Classification Search
CPC .... D04H 18/02; D04H 18/00; B21B 15/0042; B23P 19/00; B23P 19/007; B23P 19/04; B23P 19/10; B23P 19/107; B23P 19/12; B23P 21/00; B25B 21/00; B25B 21/002; B21J 15/32; B23Q 3/062; B23Q 3/064; B23Q 3/10; B23Q 3/157; Y10T 29/4973; Y10T 29/4978; Y10T 29/53796
USPC ..... 483/7, 17, 18, 30
See application file for complete search history.

(56) References Cited

U.S. PATENT DOCUMENTS 4,568,010 A * 2/1986 Dilo ..... D04H 18/02 227/120
4,936,497 A * 6/1990 Ordelt ..... D04H 18/02 112/171
6,393,693 B1 * 5/2002 Finocchi ..... D04H 18/00 29/244
2003/0225411 A1 12/2003 Miller
(Continued)

FOREIGN PATENT DOCUMENTS

DE 19 12 670 U 3/1965
DE 19 23 665 U 9/1965
(Continued)

*Primary Examiner* — Amy Vanatta
(74) *Attorney, Agent, or Firm* — McGlew and Tuttle, P.C.

(57) ABSTRACT

A needle removing tool (2) and a needle removing device (1) are provided for needles (4, 5) on needle boards (3) of needle looms. The needle removing tool (2) includes a hollow mechanical extraction device (11) for intact and damaged needles (4, 5). The extraction device (11) is motor-driven in such a way as to be rotationally and linearly movable. The extraction device (11) is provided with an elongate extraction sleeve (12) that has an axial hole (18) and a lateral axial slot (20) on the sleeve jacket (19).

20 Claims, 8 Drawing Sheets

(56) References Cited

U.S. PATENT DOCUMENTS

| | | | | |
|---|---|---|---|---|
| 2005/0049126 | A1* | 3/2005 | Everson | B21J 15/142 483/47 |
| 2013/0255047 | A1* | 10/2013 | Sasur | D04H 17/00 28/108 |
| 2014/0026379 | A1* | 1/2014 | Herzog | B23P 19/04 28/115 |
| 2014/0066277 | A1* | 3/2014 | Nagy | B25F 1/04 483/54 |
| 2016/0122926 | A1* | 5/2016 | Herzog | D04H 18/02 28/115 |
| 2016/0273143 | A1* | 9/2016 | Schneider | D04H 18/02 |

FOREIGN PATENT DOCUMENTS

| | | | |
|---|---|---|---|
| DE | 3 743 979 | C1 | 6/1989 |
| DE | 39 41 159 | A1 | 6/1990 |
| DE | 10 2011 016 755 | B3 | 10/2012 |
| DE | 20 2013 104925 | U1 | 9/2014 |
| JP | H02 53951 | A | 2/1990 |

* cited by examiner

NEEDLE REMOVING TOOL, NEEDLE REMOVING DEVICE AND NEEDLE REMOVING METHOD

CROSS REFERENCE TO RELATED APPLICATIONS

This application is a United States National Phase Application of International Application PCT/EP2016/075336, filed Oct. 21, 2016, and claims the benefit of priority under 35 U.S.C. § 119 of German Application 20 2015 105 693.1, filed Oct. 26, 2015, the entire contents of which are incorporated herein by reference.

FIELD OF THE INVENTION

The present invention pertains to a needle removing tool, to a needle removing device and to a needle removing method.

BACKGROUND OF THE INVENTION

Manual needle removing tools for needle boards that are inserted above the needles by an operator are known from practice, wherein a tilting and capturing of the needle point in the oblique position of the tool is necessary for damaged, especially bent or broken-off needles.

DE 10 2011 016 755 B3 teaches the use of an articulated-arm robot for the automated mounting and removal as well as maintenance of a needle board, which requires a relatively high design effort and programming effort.

SUMMARY OF THE INVENTION

An object of the present invention is to provide an improved needle removing technique.

The present invention accomplishes this object with the features described in the principal method claims and the principal device claims. The needle removing technique according to the invention, especially the needle removing tool, the needle removing device and the needle removing method, have a variety of advantages.

On the one hand, they manage with a low design and cost effort and little space requirement. The needle removing process can be carried out quickly and reliably. Intact and damaged needles can be detected with the needle removing tool and be at least partially extracted from the needle board. An extraction device, which may be present, can completely remove the partially extracted needles from the needle board.

An extraction device, which is linearly and rotatingly movable and thereby motor-driven, can detect and extract both intact and damaged needles. Due to the rotation, damaged, especially bent needles may also be detected and picked up as well as extracted by the hollow extraction device during the feed. The respective driven rotary motion and axial or linear feed motion may be superimposed on one another. In a process variant, all needles may be extracted with a rotating and feed motion.

The axial or linear feed is sufficient for intact needles, wherein the rotation may be omitted. The extraction process may run faster in case of intact needles. In this case, the feed speed may especially be higher than during the capturing of damaged needles with superimposed rotation. In another process variant, this permits an increased efficiency, when damaged needles are found and located by a prior detection process, the combined feed and rotary motion only being carried out for these damaged needles. The other intact needles may be extracted with the faster feed without rotation.

The extraction device has an elongated extraction sleeve with an axial and preferably central hole and a lateral axial slot on the sleeve jacket in the preferred and especially effective embodiment. The hole may have a blind-hole-like configuration and extend together with the axial slot only over a partial area of the sleeve length.

The extraction device has a preferably central and longitudinal axis, which is hereinafter also called central axis or central and feed axis. The extraction device is oriented with its central and feed axis flush with the longitudinal axis of the needle for extracting a needle. The feed motion and possibly the rotary motion take place about and along the central and feed axis of the extraction device. A bent needle can be captured and received in the lateral axial slot during the rotation of the extraction sleeve. Slightly bent needle points can thereby again be at least approximately oriented into the desired position. In case of greater bendings, the needle point can be cut off, especially sheared off and again ejected from the lateral axial slot. It is advantageous for this when the needle removing tool and the needles are oriented essentially horizontally during the needle removing process.

For the capturing of a bent needle point, it is advantageous when the lateral axial slot has a slope expanding the slot orifice at the front orifice. The other side wall may be oriented linearly or axially. It may be in the front in the direction of rotation of the extraction sleeve.

For the reliable capturing and extraction of intact and, above all, damaged, especially bent, needles as well, it is advantageous when the rotating extraction device, especially an extraction sleeve, is guided linearly and rigidly along the central and feed axis during the axial feed. As a result, a lateral migration or wobbling of the extraction device can be avoided. Wobbling has proven to be unfavorable in some applications.

Further, it is advantageous when the ratio between the rotation speed and the feed speed of the extraction device can be set. Depending on the type of needles, there is an optimal ratio between the two speeds for the reliable capturing of damaged, especially bent, needles.

Further, it is advantageous in this connection and also in general when the needle removing tool has a feed drive and a rotary drive for the extraction device. These are preferably separate drives, which may also be set or controlled or also regulated differently.

In case of the hollow extraction device, especially the extraction sleeve, the front area is especially under mechanical stress. For the stability thereof, it is advantageous when an essentially flat front wall is present. This front wall may enclosed on the edge by an annular, uniform, outer phase.

For capturing a damaged, especially bent, needle, it is advantageous when the lateral axial slot is oriented with its principal plane essentially radially to the central axis and to the preferably central hole. The lateral axial slot advantageously has parallel side walls. In the front area of the extraction device, especially of the extraction sleeve and head part there, the slot width may be relatively small. The slot width may expand in the rear slot area adjacent to the head part in a chamfer on both sides. The expansion may have rounded front and rear areas. This configuration is cost-effective and easy to manufacture. Moreover, the chamfer provided on both sides facilitates the ejection of cut-off needle points.

The needle removing device has a suitable and preferably multiaxial manipulator for the relative positioning of the needle board and its needles, on the one hand, and of the needle removing tool, on the other hand. This manipulator can move the needle removing tool and/or the needle board. The needle removing tool is preferably arranged in a stationary manner and the manipulator moves the needle board. For said relative motion, the manipulator has a preferably multiaxial configuration. The manipulator may be controlled precisely for the positioning tasks and is equipped for this with a corresponding control unit and a referencing device for the position definition of the needle board in relation to the manipulator. The needle removing device may further have a device for detecting damaged needles. This detection device operates preferably optically and may, in particular, be configured as a camera, which is likewise connected to the control unit and can also precisely locate the damaged needles.

The present invention is shown schematically and with examples in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
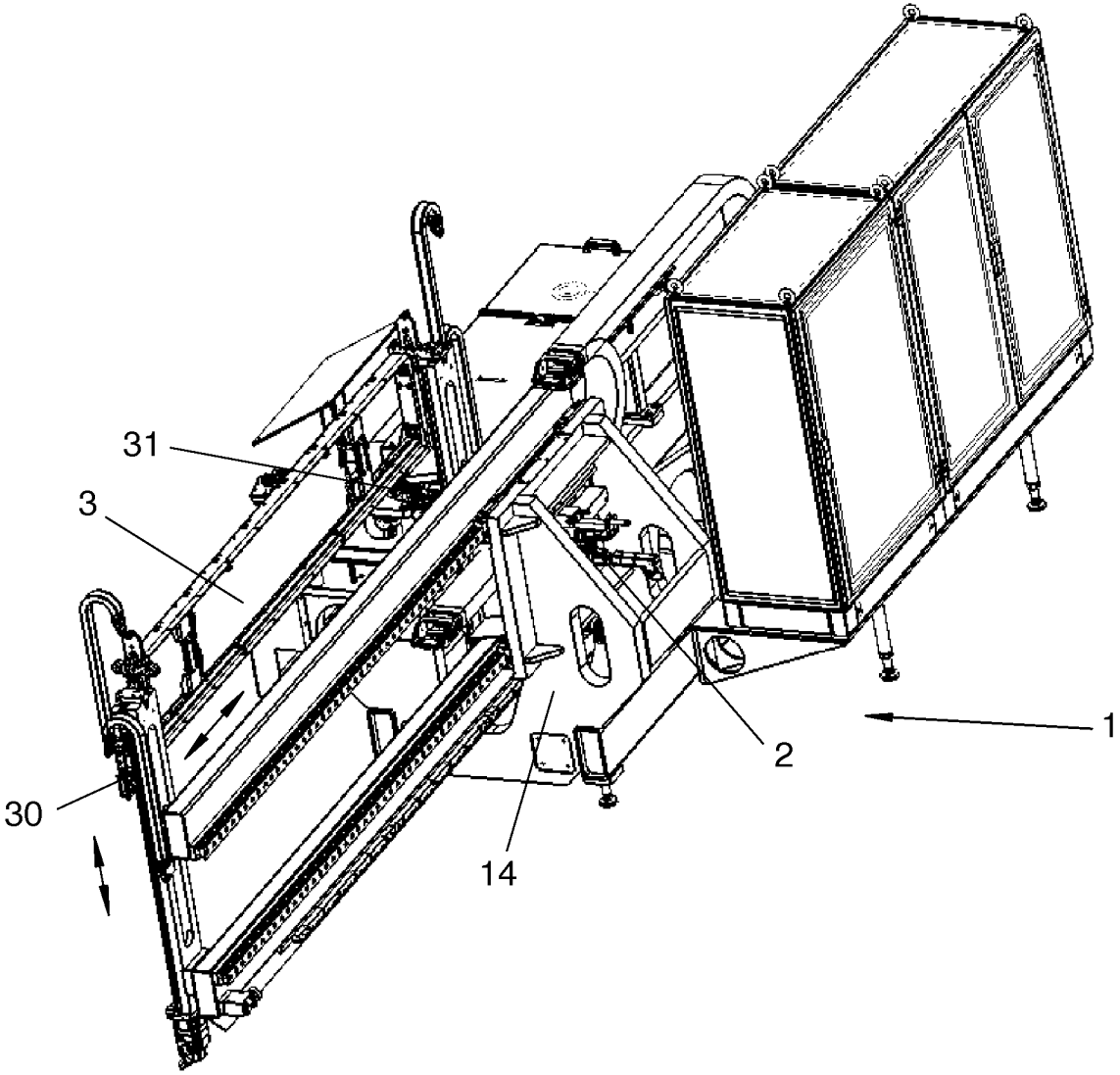
FIG. 1 is a perspective overall view showing a needle removing device.

Referring to the drawings, the present invention pertains to a needle removing tool (2) and to a needle removing device (1) equipped with such a needle removing tool (2). The present invention further pertains to a needle removing method.

The needle removing tool (2) and the needle removing device (1) as well as the needle removing method are used to extract intact needles (4) and damaged needles (5) from a needle board (3). The needle (4, 5) is thereby at least partially pushed out or extracted out of the needle board (3) with a force acting on its point (6) and a motion rearwards. A partially pushed-out or extracted needle (4, 5) can be grasped by an extraction device (31) on the opposite side of the needle board (3) and be removed from the needle board (3). The extraction device (31) may be a component of the needle removing device (1).

Figure 3:
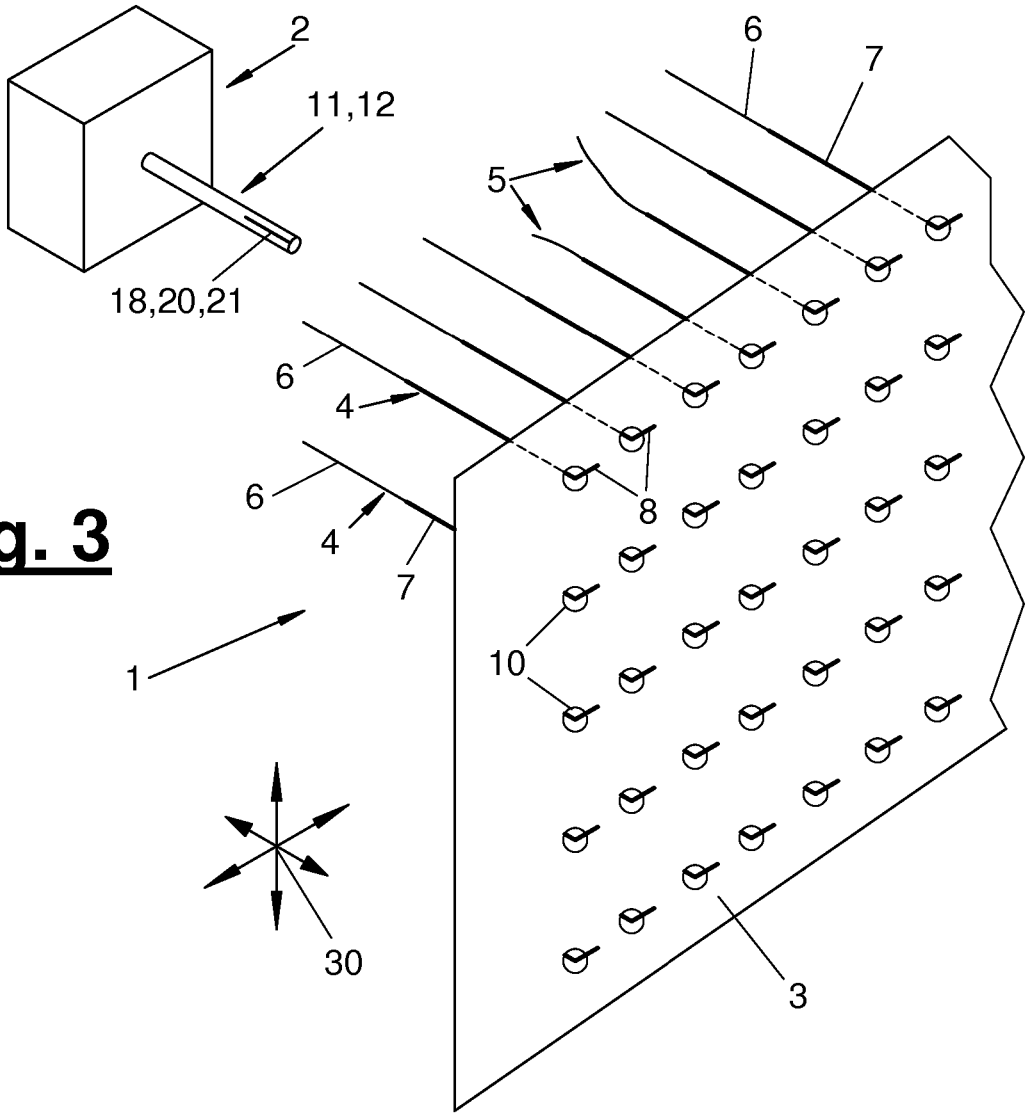
FIG. 3 is a schematic view of the needle removing tool and the needle board with intact and damaged needles.
Figure 4:
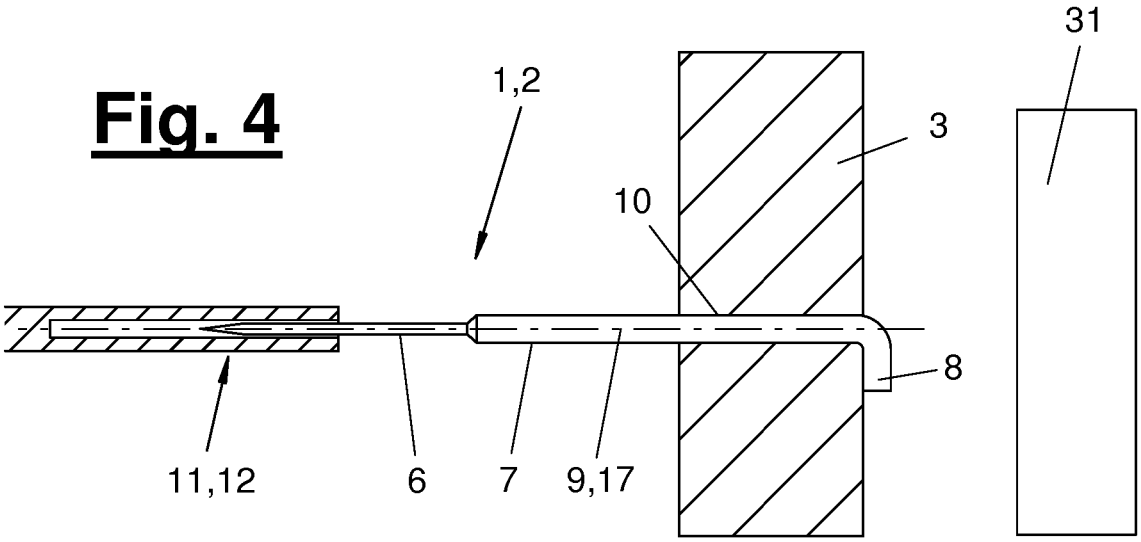
FIG. 4 is a schematic view of the interaction of the needle removing tool, the needle board and the extraction device.

FIGS. 3 and 4 show the shape of the needles (4, 5) in a schematic view. They have a preferably linear shank, which is bent over at the rear end. The bending over preferably at right angles is called a crank (8). The needle (4, 5) has a needle point (6) with a relatively small diameter at the front end. In the area of the needle point (6), projections or barbs may be arranged at the lateral shank area and at the point. The needle point (6) may have a length of several cm. At least one shank thickened portion (7) adjoins the needle point (6) in the direction toward the rear needle end. This shank thickened portion (7) may form an extraction resistance for the extraction tool (2). The needle cross section has an essentially circular or oval configuration in the embodiments shown. It may, as an alternative, have a different, e.g., prismatic or star-shaped shape in at least some areas.

The needles (4, 5) are inserted in a clamping manner with their thickened rear area into the opening (10) of the needle board (3) and oriented at right angles to the board plane. The crank (8) lies on the rear side of the needle board (3) located opposite the needle point (6). The needle board (3) is used in a needle loom, with which textile fiber materials, especially nonwoven fibrous webs or fibrous nonwovens, are needled and strengthened. The needles (4, 5) shown are correspondingly configured for this purpose. As an alternative, the needle board (3) and the needles (4, 5) may be used for other purposes and have a correspondingly different configuration.

As FIG. 3 shows, the intact needles (4) are oriented linearly and along their central longitudinal axis (9). Some needles may become damaged during the needling process. These damaged needles (5) shown in FIG. 3 are bent, e.g., in the area of the needle point (6). They may also have bent and broken-off needle points (6). Both intact needles (4) and damaged needles (5) can be extracted from the needle board (3) with the needle removing tool (2).

The needle removing tool (2) has a hollow mechanical extraction device (11) for extracting intact and damaged needles (4, 5). The extraction device (11) may be rotated as well as moved linearly and is thereby motor-driven. The extraction device (11) has a preferably central and longitudinal axis (17). The central axis (17) is at the same time the feed axis for the linear feed motion and the axis of rotation for the rotary motion of the extraction device (11).

According to FIG. 3, the extraction device is oriented with its central and feed axis (17) flush with the longitudinal axis (9) of the needle (4, 5) in question for extracting a needle (4, 5). The extraction device (11) rotating about the central axis (17) is guided precisely linearly and rigidly along the central and feed axis during the axial feed.

The ratio between the rotation speed and the feed speed of the extraction device (11) can be set to a suitable value. This value can be determined, e.g., by tests or be taken from a technology database. Said speed ratio may possibly also be controlled or regulated.

The needle removing device (1), especially the needle removing tool (2), has a feed drive (29) and a rotary drive (28) for the extraction device (11). These drives are preferably separate motor drives (28, 29). These drives may be configured, e.g., as electric motors, air motors or the like. The drives (28, 29) may possibly be set mutually dependent on one another and with regard to the optimized speed ratio, preferably controlled or possibly regulated in connection with a corresponding sensor mechanism as well.

The extraction device (11) may be configured in any desired, suitable manner. In the exemplary embodiments shown and preferred, the extraction device (11) has an elongated extraction sleeve (12), which has an axial and preferably central hole (18) and a lateral axial slot (20) on the sleeve jacket (19). The longitudinal axis of the extraction sleeve (12) is said central axis (17).

The extraction sleeve (12) or the sleeve jacket (19) preferably has a linear shape and a, e.g., circular or oval outer circumference. As an alternative, a prismatic circumferential contour is possible. The slim extraction sleeve (12) has such a small diameter that it has sufficient distance to the adjacent needles in the needle board (3) for extracting a needle (4, 5).

The lateral axial slot is oriented with its central principal plane preferably radially to the central axis (17). The lateral slot walls may be oriented parallel to one another and to said principal plane. The lateral axial slot (20) reaches into the depth up to the hole (18) and enters there. The lateral axial slot (20) is thereby open outwards on the sleeve jacket (19) and inwards towards the hole (18).

Figure 8:
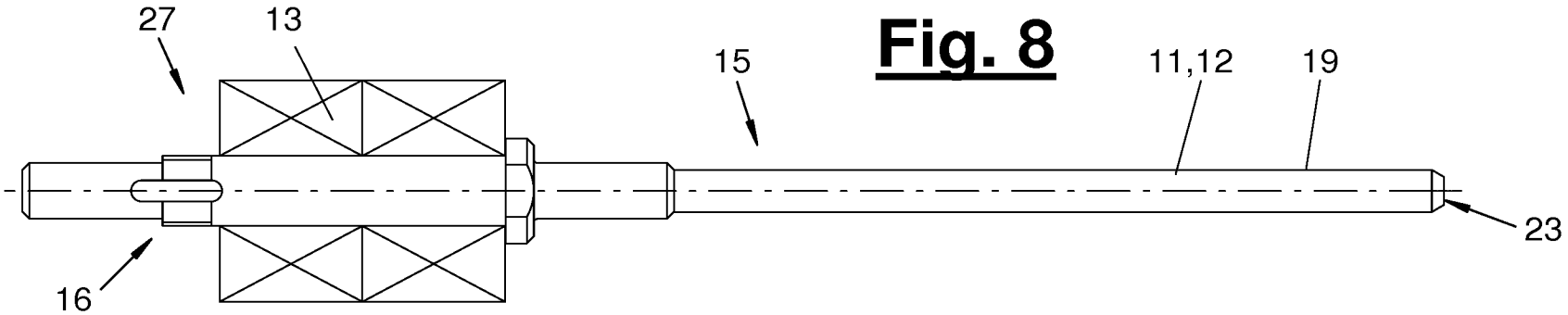
FIG. 8 is lateral view showing the extraction sleeve from FIG. 7.
Figure 9:
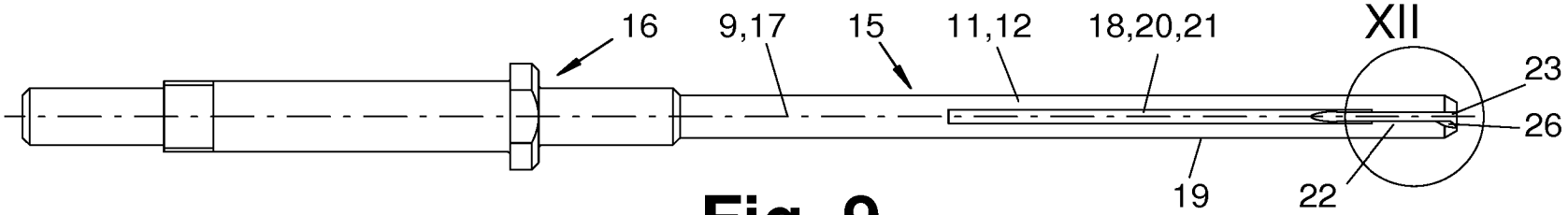
FIG. 9 is another lateral view showing the extraction sleeve from FIG. 7.
Figure 10:
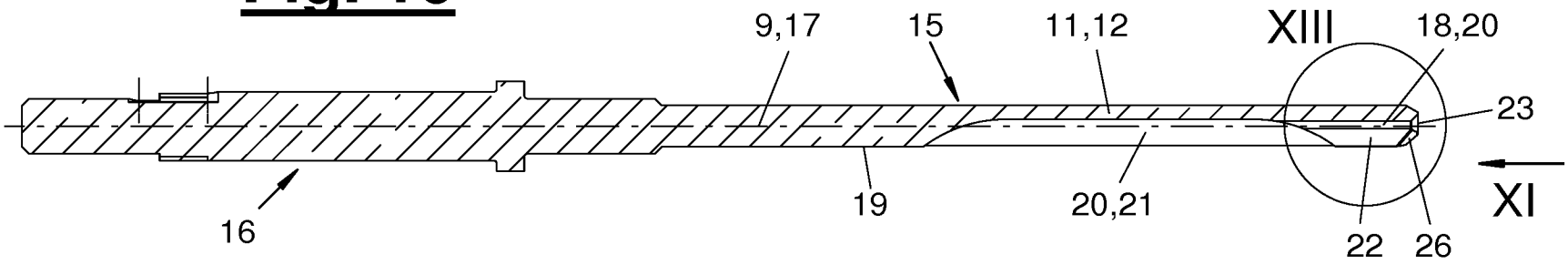
FIG. 10 is lateral sectional view according to section line X-X from FIG. 11.

As FIGS. 8 through 10 show, the extraction device (11), especially the extraction sleeve (12), is arranged in a front, hollow end area (15) and a rear, e.g., solid end area (16). The axial hole (18) and the axial slot (20) are arranged at the front end area (15) of the extraction device (11), especially of the extraction sleeve (12). They are adapted in their width to the breadth of the needle point (6).

The axial hole (18) and the lateral axial slot (20) are preferably of equal length. Starting from the front side, they reach only over a part of the length of the extraction device (11), especially of the extraction sleeve (12). Their length is coordinated with the length of the needle point (6) up to an extraction resistance (7), especially said shank thickened portion. The extraction device (11), especially the extraction sleeve (12), can thus receive the needle point (6) in its axial hole (18) and in its lateral axial slot (20) during the extraction.

Figure 11:
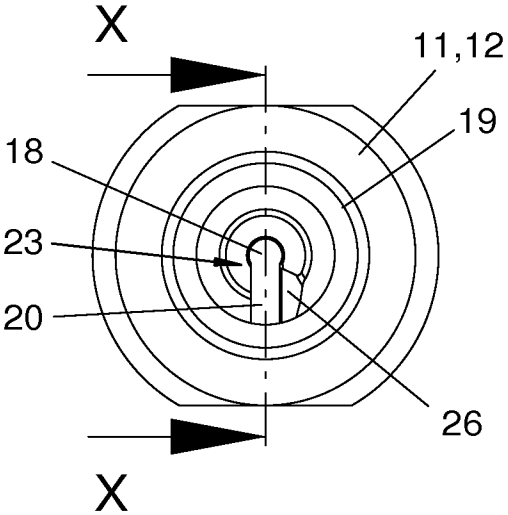
FIG. 11 is an end view from direction XI of FIG. 10.
Figure 13:
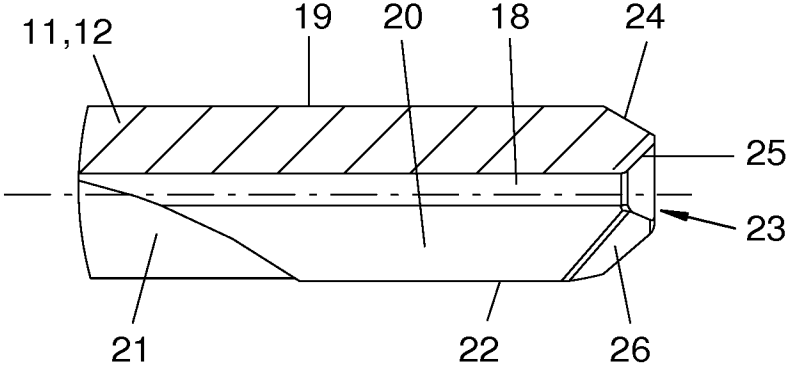
FIG. 13 is enlarged detail view of detail XIII from FIG. 10.

The lateral axial slot (20) has a width at a front end of the extraction sleeve (12) and a head part (22) there, which width corresponds to the diameter of the axial hole (18). According to FIG. 11, the lateral and preferably parallel slot walls are essentially tangentially adjacent to the circumference of the preferably circular hole.

Figure 14:
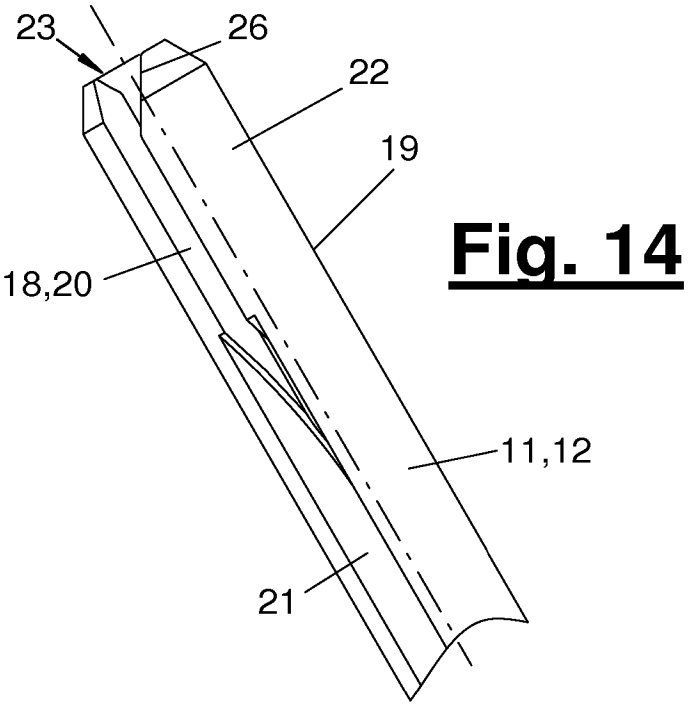
FIG. 14 is another broken-away perspective view of the front end of the extraction sleeve.
Figure 12:
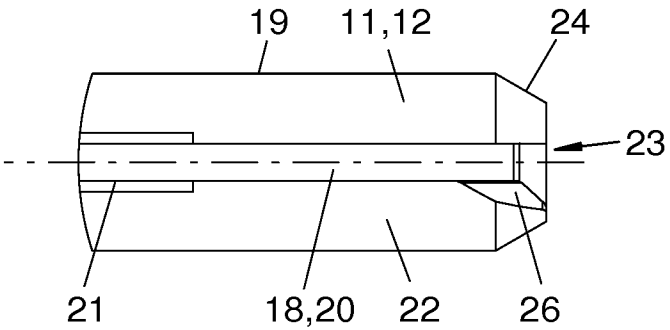
FIG. 12 is enlarged detail view of detail XII from FIG. 9.

At its rear area that is adjacent to the head part (22), the lateral axial slot (20) may have a broadened slot width (21) on both sides and possibly a chamfer. The slot width here is greater than in the area of the head part (22). The rear end of the chamfer (21) or of the axial slot (20) is rounded according to FIGS. 10, 11 and 14. Likewise, the step at the transition to the head part (22) is rounded. The chamfer (21) can be formed, e.g., by a side milling cutter and the more narrow slot area at the head part (22) by an electrical discharge machining tool. The slot expansion (21) is advantageous, but not absolutely necessary.

The axial hole (18) and the lateral axial slot (20) have a common orifice (23) at the front end of the extraction sleeve (12), especially of the head part (22). A side wall of the axial slot (20) has at the orifice (23) a slope (26), which expands the front slot orifice outwards. The slope (26) is inclined towards the adjacent slot wall in two directions. The slope is bent obliquely at an angle from the slot wall plane outwards and is, moreover, rotated about the longitudinal direction of the slot wall.

The slope (26) is preferably configured as a flat wall area. As viewed from the front according to FIG. 11, it can form an acute angle of, e.g., 20° to 50°, preferably about 30°, with the central axis (17). The other, opposite slot wall may have a linear and axial orientation.

Figure 5:
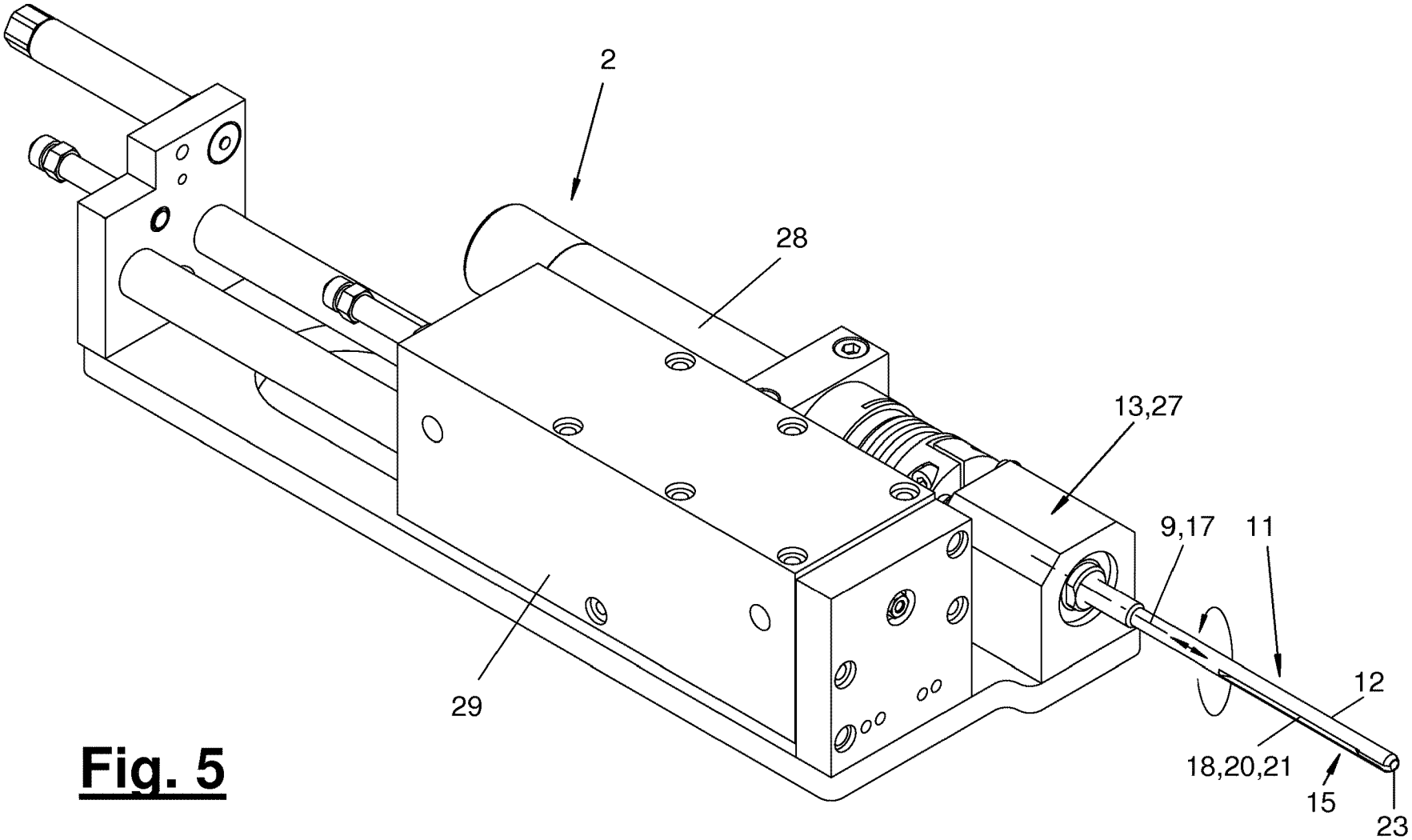
FIG. 5 is a perspective view showing the needle removing tool with extraction device and drives.
Figure 6:
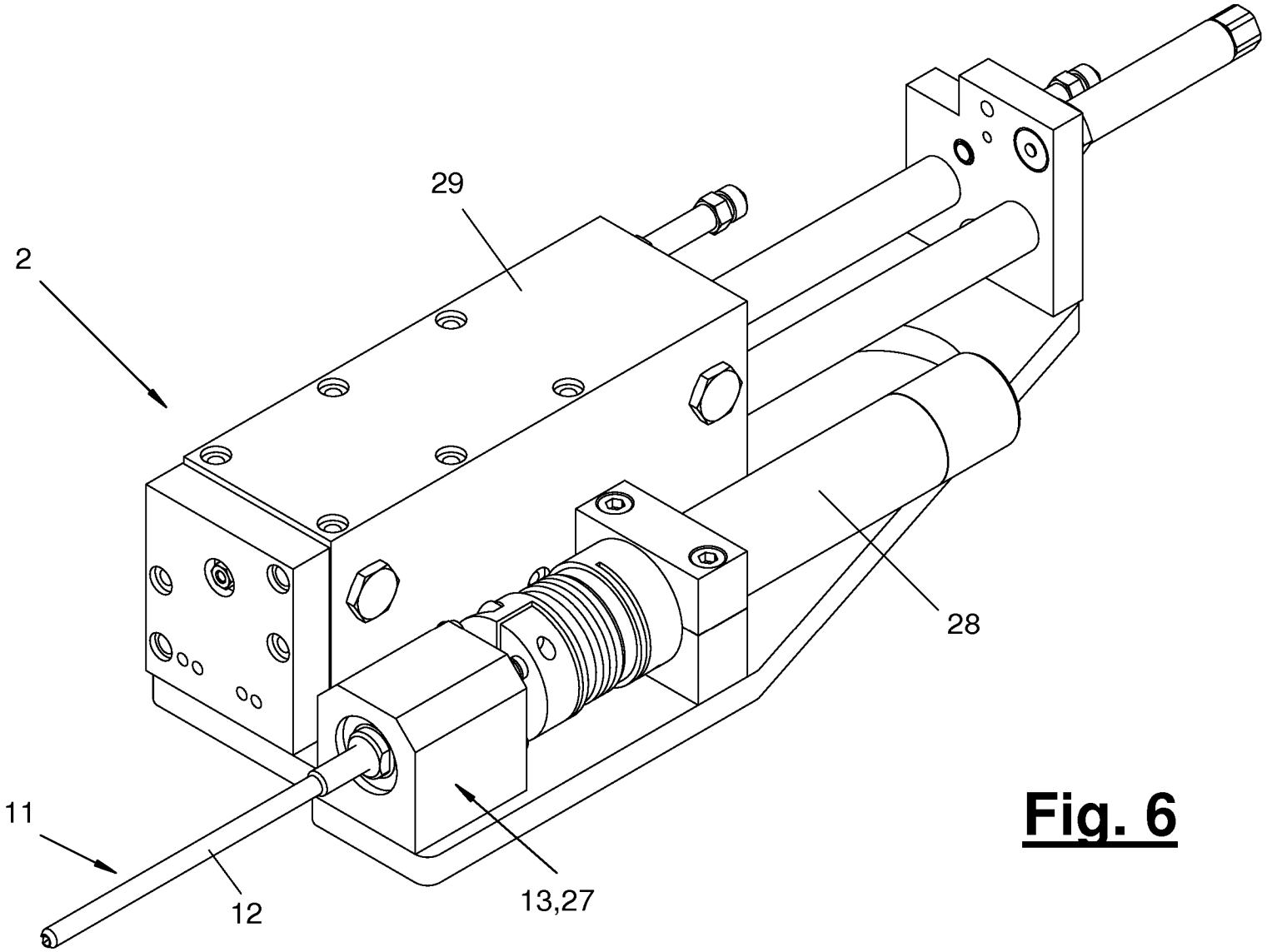
FIG. 6 is another perspective view showing the needle removing tool with extraction device and drives.
Figure 7:
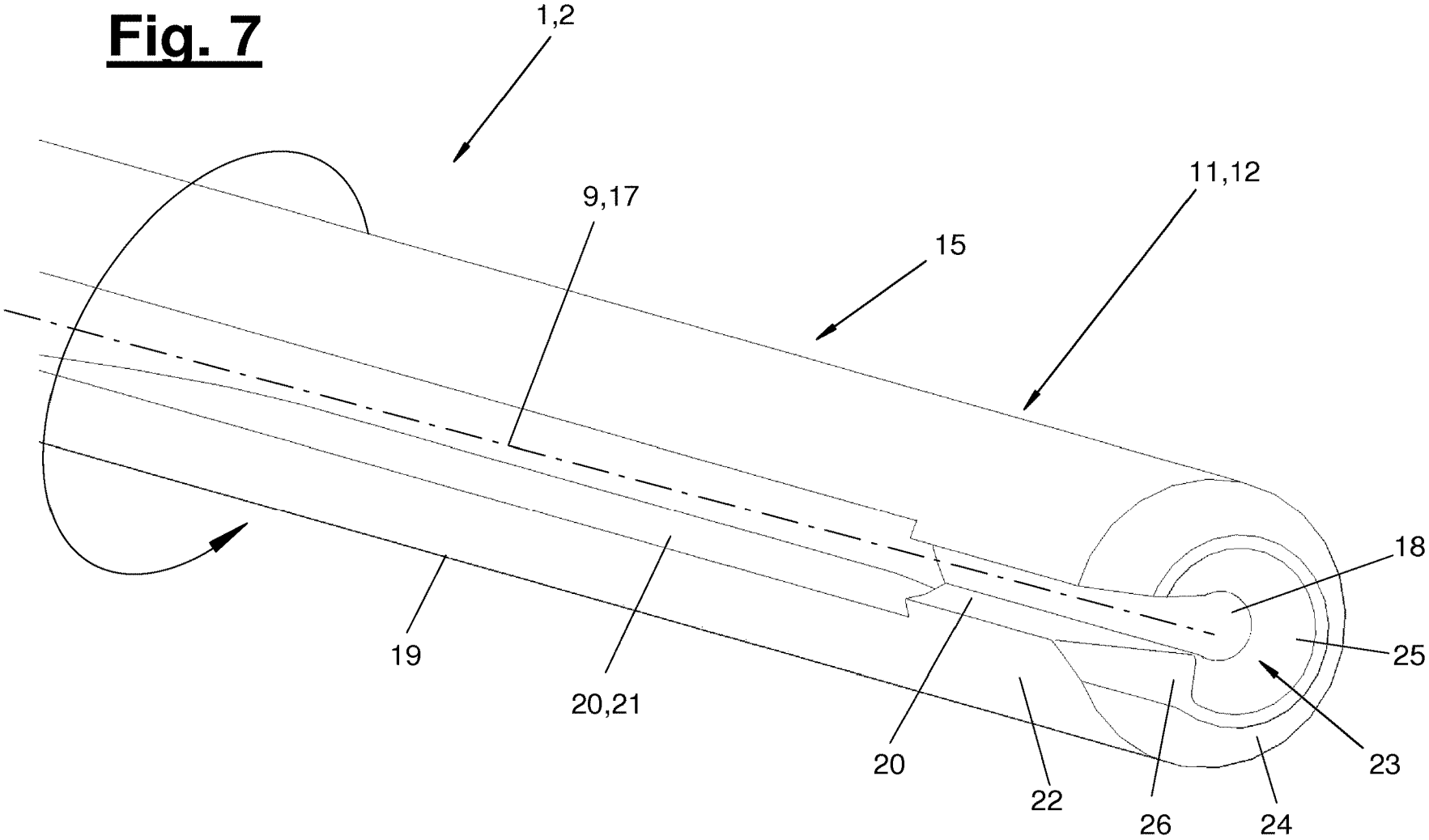
FIG. 7 is a broken-away and enlarged, perspective view of the front end of an extraction sleeve.

In the embodiment shown and preferred, the linear and axial slot wall is in the front in the direction of rotation of the extraction sleeve (12), which is indicated by an arrow in FIG. 5. As a result, it first becomes meshed with a bent needle point (6) of a damaged needle (5) and picks this up during the rotation. The slope (26), which is located further to the rear in the direction of rotation, can support the penetration of said needle point (6) into the lateral axial slot (20) and can act as an oblique sliding surface.

The extraction sleeve (12) may have an essentially flat front wall at its front end. This front wall encloses said orifice (23). The front wall may have a flat configuration or may be configured with a slightly convex arch. It may be oriented at right angles to the central axis (17). Further, the extraction sleeve (12) may have an annular, uniform, outer bevel on the edge at said front end. This outer bevel is adjacent to the flat front wall. An inner bevel (25) is arranged at the orifice (23) of the axial hole (18).

For extracting a needle (4, 5), the extraction device (11), especially the extraction sleeve (12), and said needle (4, 5) are oriented coaxially to one another, and the extraction device (11) is then fed axially and thereby possibly rotated about the central axis (17). The linear needle point (6) of an intact needle (4) or of a broken-off, but still linear needle (5) dips into the axial hole (18) without resistance.

At the end of the axial feed motion, the extraction device (11) stops with its front end, especially with the orifice (23), at an extraction resistance (7), e.g., at a shank thickened portion or another lateral projection, of the needle (4, 5) and then with a continued feed motion presses said needle rearwards out of the opening (10) in the needle board (3). The needle (4, 5) can thereby be fully or partially pushed out of the needle board (3).

The rotation of the extraction device (11) about the central axis (17) is only necessary when extracting a damaged needle (5) with a bent needle point (6). Due to the rotation, the bent needle point (6) is captured and received in the lateral axial slot (20). A more intensely bent needle point (6) can thereby be cut off, especially sheared off. The cut-off needle point (6) can be ejected from the rear expanded slot area (21) or from the chamfer. Over the further feed path, the damaged needle (5) is pushed out or extruded rearwards out of the receptacle opening (10) in the above-mentioned manner due to the stopping of the front end of the extraction device (11) at the extraction resistance (7).

The extraction device (31) arranged on the opposite side of the needle board (3) may have a controllable tong or another suitable gripping instrument for the preferably mechanical gripping of the rear needle end, especially of the crank (8), and pull the gripped needle (4, 5) out of the needle board (3) during a retracting motion. The exposed needle can be reused or discarded. In this case, it may be subjected to a, e.g., optical checking and be classified. The extraction device (31) may be a component of a needle placement device, with which new needles or recycled, used needles can then be inserted into the openings (10) of the needle board (3).

The extraction device (11), especially the extraction sleeve (12), is connected at its rear end area (16), on the one hand, to a receptacle (27), especially to a sleeve receptacle. A mount (13) may be present here between the receptacle (27) and the extraction device (11). The mount (13) may have, e.g., a slide bearing or rolling bearing arrangement, especially a tensioned angular contact bearing arrangement. This mount may form both a compiled radial bearing and axial bearing. A precise concentric rotatable mounting and a precise concentricity of the extraction device (11) are ensured due to the mount (13).

The receptacle (27) is connected to one of the two drives (28, 29), and especially to the rotary drive (28). The rotary drive (28) may in turn be arranged at the feed drive (29) or be acted on by same. The receptacle (27) and the extraction device (11) are guided precisely linearly and rigidly along the central axis (17) during the feed. For this, e.g., the receptacle (27) can be mounted and guided at a slot-like linear guide. The rotary drive (28) can also be moved during the feed.

For said extraction, the acted-on needle (4, 5) or the needle board (3) and the needle removing tool (2) are moved and positioned in relation to one another. For this, a controllable manipulator (30) is provided, which is connected to a control unit, not shown, of the needle removing device (1). The manipulator (30) can move the needle removing tool (2) or the needle board (3) or both in relation to one another.

In the embodiment shown and preferred, the manipulator (30) moves the needle board (3) and positions it with the respective needle (4, 5) to be extracted towards the needle removing tool (2), which is held stationary on a frame (14). The extraction device (31) may be arranged likewise in a stationary manner axially opposite the needle removing tool (2) on the frame (14) of the needle removing device (1).

The manipulator (30) preferably has a plurality of axes of motion that are symbolized by arrows in FIGS. 1 and 3. In this connection, the manipulator may have any desired number and combination of rotatory and/or translatory axes of motion. In the embodiments shown, the manipulator (30) has two or more linear axes of motion, which are oriented at right angles and preferably vertically and horizontally. The manipulator, is configured, e.g., as a cross slide drive or as a programmable linear robot. As an alternative, a configuration as an articulated-arm robot is possible.

The manipulator (30) receives the needle board (3) in a defined or referenced position. The control unit knows thereby both the shape, dimensions and position of the needle board (3) and the hole pattern and the position of the needles (4, 5) contained therein. The manipulator (30) can hence precisely position the needle (4, 5) to be extracted and the needle removing tool (2) coaxially and relative to one another.

The needle board (3) is preferably oriented vertically during the needle removing process, wherein the needles (4, 5) assume a horizontal position. The needle removing tool (2) and its direction of action, especially the central axis (17), are likewise oriented horizontally. Broken-off needle points (6) can thereby fall downwards and leave the process area. In another embodiment the needle board (3) may assume an upright and slightly inclined position, wherein the needles (4, 5) and the central axis (17) are oriented correspondingly obliquely, especially at right angles, thereto.

In a first design and process technological embodiment, the extraction device (11) is fed axially and thereby rotated during the extraction of all needles (4, 5). As a result, an automatic detection and possible cutting off of bent needle points (6) take place during the extraction. This embodiment is especially cost-effective because the needle removing tool (2) effects the detection and treatment of damaged needles (5) at the same time.

In another embodiment, damaged needles (5) are detected in a different way before the extraction. This may be carried out by a suitable detection device (32). This detection device (32) may carry out, e.g., an optical detection and is for this purpose configured as an electronic and digital measuring camera. It optically detects the quality of the action areas of the needles (4, 5), especially of the needle points (6). It can thereby detect bendings of a needle point (6), broken-off needle points (6) or even wear or other wear and tear phenomena or defects. The detection device (32) is connected to said control unit and may also detect the precise position of the needle (4, 5) in question and report to the control unit during the detection of the needle quality.

Figure 2:
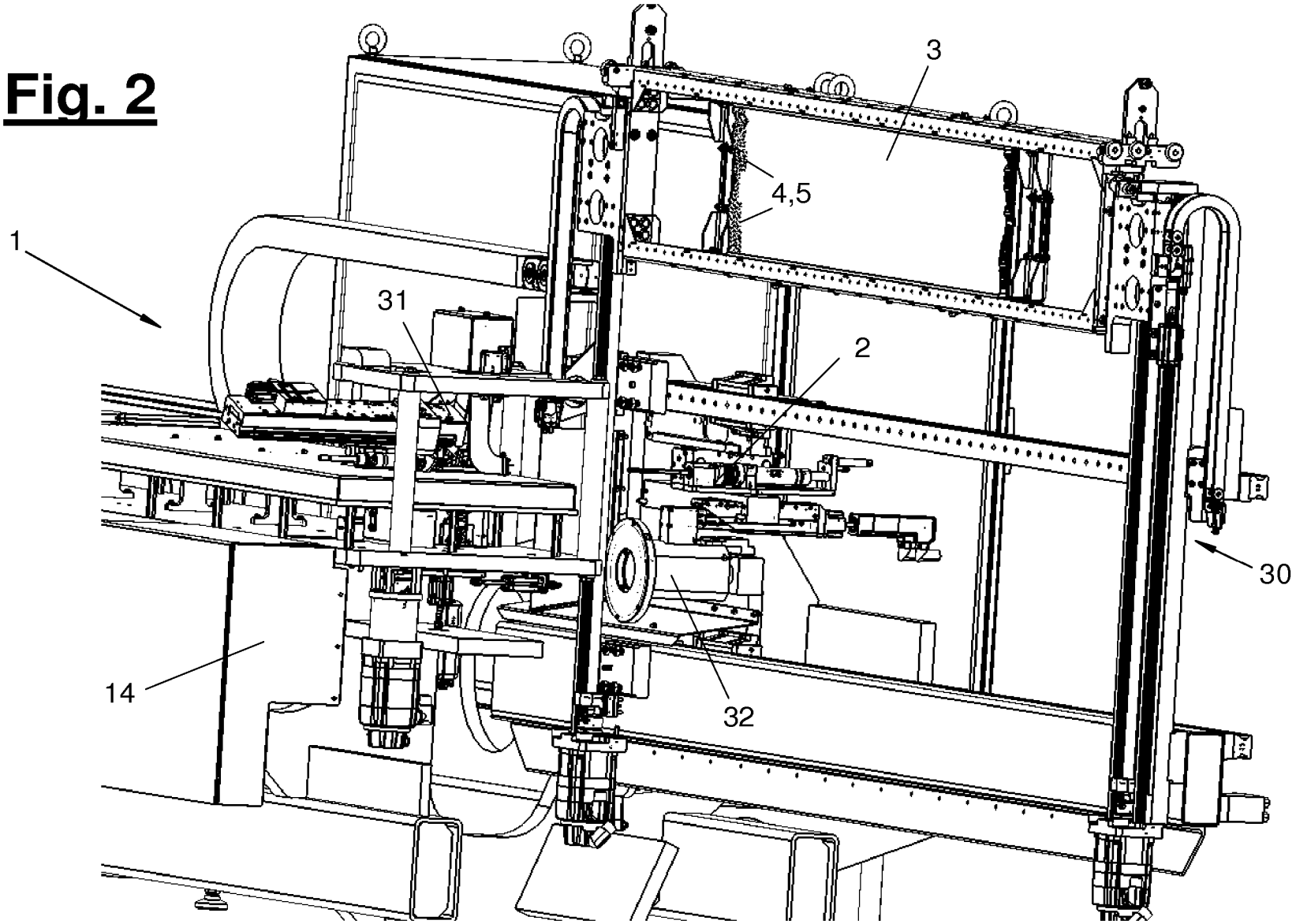
FIG. 2 is a perspective detail view of a needle removing tool with a detection device for damaged needles and an extraction device in connection with a manipulator for the multiaxial motion of a needle board.

The detection device (32) and the needle board (3) can be moved in relation to one another in a variety of ways. In the embodiment shown according to FIG. 2, the detection device (32) is arranged in a stationary manner on the frame (14) and is located, e.g., below the needle removing tool (2) with a front viewing direction towards the needles (4, 5). The needle board (3) is moved by the manipulator (30) in relation to the detection device (32). The detection device (32) may also be located on an adjusting axis or servo axis and be moved obliquely to the principal plane of the needle board (3). It can thereby be moved towards the needle board (3) and back. As a result, e.g., various needle lengths can be detected.

In principle, said relative motion of the detection device (32) and the needle board (3) along the principal plane of the needle board (3) can take place in any desired manner. In further variants, the detection device (32) can be moved along one or more axes of motion in relation to the stationary or likewise moved needle board (3).

A variety of variations of the embodiments shown and described are possible. In particular, the features of the exemplary embodiments and of the variants mentioned can be combined, especially also transposed, with one another in any desired manner.

While specific embodiments of the invention have been shown and described in detail to illustrate the application of the principles of the invention, it will be understood that the invention may be embodied otherwise without departing from such principles.

The invention claimed is:

1. A needle removing tool for needles on needle boards of needle looms, the needle removing tool comprising:

a hollow mechanical elongated extraction device for extracting intact and damaged needles; and a first motor drive whereby the extraction device is motor-driven rotatably at a selectable rotation speed;

a second motor drive whereby the extraction device is motor-driven linearly at a feed speed, said first and second motor drives being configured to selectively set a ratio between said rotation speed and said feed speed.

2. A needle removing tool in accordance with claim 1, wherein the elongated extraction device has a central and longitudinal axis, with the extraction device being motor-driven linearly along the axis and rotatably about the axis, the extraction device rotating about the axis being guided linearly and rigidly along the axis while being motor-driven linearly.

3. A needle removing tool in accordance with claim 1, wherein the extraction device has an elongated extraction sleeve with an axial hole, a sleeve jacket, and with a lateral axial slot on the sleeve jacket.

4. A needle removing tool in accordance with claim 3, wherein the lateral axial slot reaches in depth up to the axial hole and the lateral axial slot enters the axial hole.

5. A needle removing tool in accordance with claim 3, wherein:

the axial hole and the axial slot are arranged at a front end area of the extraction device; and the axial hole and the lateral axial slot are coordinated in length to a length of a needle point up to an extraction resistance comprising a shank thickened portion.

6. A needle removing tool in accordance with claim 3, wherein the axial hole and the lateral axial slot are adapted in width thereof to a breadth of a needle point.

7. A needle removing tool in accordance with claim 3, wherein:

the lateral axial slot has a width that corresponds to a diameter of the axial hole on a front head part of the extraction sleeve the lateral axial slot has a broadened slot width on both sides at an axial slot rear area adjacent to the head part.

8. A needle removing tool in accordance with claim 3, wherein the axial hole and the lateral axial slot have a common orifice at a front end of the extraction sleeve.

9. A needle removing tool in accordance with claim 3, wherein a side wall of the lateral axial slot has a slope expanding a slot orifice at the slot orifice, the slope being inclined in two directions in relation to the slot wall and being configured as a flat wall area, wherein the extraction sleeve has a flat front wall at the front end, and an annular, uniform, outer bevel on an edge at the front end.

10. A needle removing tool in accordance with claim 1, wherein the extraction device has a rear end area connected to a receptacle;

a slot-like linear guide, the receptacle being mounted and guided by the slot-like linear guide.

11. A needle removing device comprising:

a needle removing tool for needles on needle boards of needle looms, the needle removing tool comprising a hollow mechanical device for extracting intact and damaged needles and a first motor drive whereby the hollow mechanical device is motor-driven rotatably at a selectable rotation speed, a second motor drive whereby the extraction device is motor-driven linearly at a feed speed, said first and second motor drives being configured to selectively set a ratio between said rotation speed and said feed speed; and a controllable manipulator positioning the needle removing tool and the needle board in relation to one another.

12. A needle removing device in accordance with claim 11, wherein the needle removing device further comprises an optical device for detecting damaged needles.

13. A needle removing device in accordance with claim 11, wherein the needle removing device has a controllable extraction device for the extracted needles.

14. A method for extracting needles on needle boards of needle looms, the method comprising the steps of:

providing a needle removing tool, comprising a hollow mechanical extraction device used for intact as well as damaged needles and a first motor drive wherein the extraction device for extracting a needle can be driven rotatably at a selectable rotation speed;

providing a second motor drive whereby the extraction device is motor-driven linearly at a feed speed;

selectively setting a ratio between said rotation speed and said feed speed;

detecting intact and damaged needles with the needle removing tool; and extracting at least partially intact and damaged needles from a needle board.

15. A method in accordance with claim 14, wherein partially extracted needles are removed from the needle board by means of an extraction device.

16. A method in accordance with claim 14, wherein damaged, bent needles are detected, picked up as well as extracted by the hollow extraction device during the motor drive of the needle removing tool due to the rotation of the extraction device.

17. A method in accordance with claim 14, wherein the extraction device has a central and longitudinal axis;

the extraction device is moved linearly along the axis and is rotated about the axis during the motor drive of the needle removing tool; and a respective, driven rotary motion and axial or linear feed motion of the extraction device are superimposed on one another.

18. A method in accordance with claim 14, wherein:

capturing and receiving a bent needle point of a needle in a lateral axial slot of the needle removing tool during the rotation of the extraction device;

a needle point bent less than a predetermined amount is oriented at least approximately into a desired position during the capturing and receiving; and a needle point bent greater than the predetermined amount is cut off, and ejected from the lateral axial slot.

19. A method in accordance with claim 14, wherein the extraction device extracts intact needles due to axial feed without rotation about the axis.

20. A method in accordance with claim 14, wherein due to a prior detection process, damaged needles are found and located as well as extracted due to a combined feed and rotary motion of the extraction device, wherein the other intact needles are extracted without rotation.

* * * * *